United States Patent [19]

Levenstein

[11] 4,138,954

[45] Feb. 13, 1979

[54] DEVICE FOR SIMULTANEOUSLY STIFFENING AND HEMMING DRAPERY PANELS

[75] Inventor: Stanley Levenstein, Woodmere, N.Y.

[73] Assignee: Home Curtain Corp., New York, N.Y.

[21] Appl. No.: 818,158

[22] Filed: Jul. 22, 1977

[51] Int. Cl.[2] ..... D05B 25/00; D05B 27/22

[52] U.S. Cl. ..... 112/155; 112/203

[58] Field of Search ..... 112/155, 141, 147, 121.11, 112/121.15, 121.29, 121.14, 203, 152, 121.27

[56] References Cited

U.S. PATENT DOCUMENTS

| | | | |
|---|---|---|---|
| 3,477,397 | 11/1969 | Hawley | 112/121.11 |
| 3,683,830 | 8/1972 | McClintock | 112/152 X |
| 3,796,171 | 3/1974 | Arbter | 112/203 X |
| 3,884,166 | 5/1975 | Rinehimer et al. | 112/141 X |
| 3,972,296 | 8/1976 | Marforio | 112/121.27 |

*Primary Examiner*—Peter Nerbun
*Attorney, Agent, or Firm*—Charles E. Temko

[57] ABSTRACT

A device for simultaneously hemming one edge of a curtain or drapery panel, while sewing a strip of buckram or other stiffening material along an oppositely disposed edge. The device includes a pair of parallel elongated panel supporting and transporting units, each having moving belts which engage an edge of the panel therebetween, and transport the panel to a sewing station. The belts are synchronized with respect to linear speed, so that opposed edges of the panel are maintained in the same relative position. One sewing station includes edge-folding means located ahead of a sewing needle. The other sewing station includes means for positioning a strip of buckram against the area of the panel adjacent an edge thereof. Photosensitive means controls thread and buckram strip severing operations at the completion of each finished panel.

3 Claims, 4 Drawing Figures

DEVICE FOR SIMULTANEOUSLY STIFFENING AND HEMMING DRAPERY PANELS

BACKGROUND OF THE INVENTION

This invention relates generally to the field of curtain and drapery manufacture, and more particularly to an improved device for performing several conventional sewing operations on an individual curtain or drapery panel in a simultaneous and semi-automated manner.

It is known in the art to form an individual panel on a mass production basis by measuring uniform lengths of material from a cloth bolt, sewing a length of buckram or other stiffening material along one edge thereof, and forming a hem along an oppositely disposed edge. The first-mentioned edge may be provided during a subsequent operation with the usual triple pinch pleat, with or without the insertion of a lining material. At the present state of the art, each operation is manually performed seriatum, by a different operator, and using such method, it is not unusual for a team of as few as four operators to complete as many as a thousand pair or draperies during a single working day. Such productivity is possible because of the use of specialized sewing machines and other hardware, which require, however, the manual initiation of each sewing step.

SUMMARY OF THE INVENTION

Briefly stated, the invention contemplates the provision of improved sewing apparatus in which at least two of the above mentioned operations may be performed simultaneously in a semi-automated manner. Since both the sewing of a buckram strip to the upper edge of a curtain or drapery panel, and the formation of the lower edge hem followed by the sewing thereof are essentially rectilinear sewing operations, they may be performed simultaneously and independently. The embodying device comprises a pair of transport and sewing units arranged in substantially parallel relation at a spaced distance corresponding to the width of panels which are serially fed therebetween. Each unit is provided with a plurality of gripping belts which engage a longitudinal edge of the panel and transport it past a sewing station where the required operation is performed. In the case of the unit sewing the buckram strip, means is provided for sewing the end of the panel edge, so that the buckram strip may be severed from a supply web of material prior to the commencement of another similar sewing operation. The other unit includes conventional means for forming and holding the hem prior to stitching. Both units are driven in synchronism, so that one longitudinal edge of the panel does not advance ahead of the other during movement of the panel through the units. Upon completion of the sewing operation performed by each unit, the gripping belts are simultaneously released and the completed panel is allowed to fall under gravity upon a stacking rack for periodic removal.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
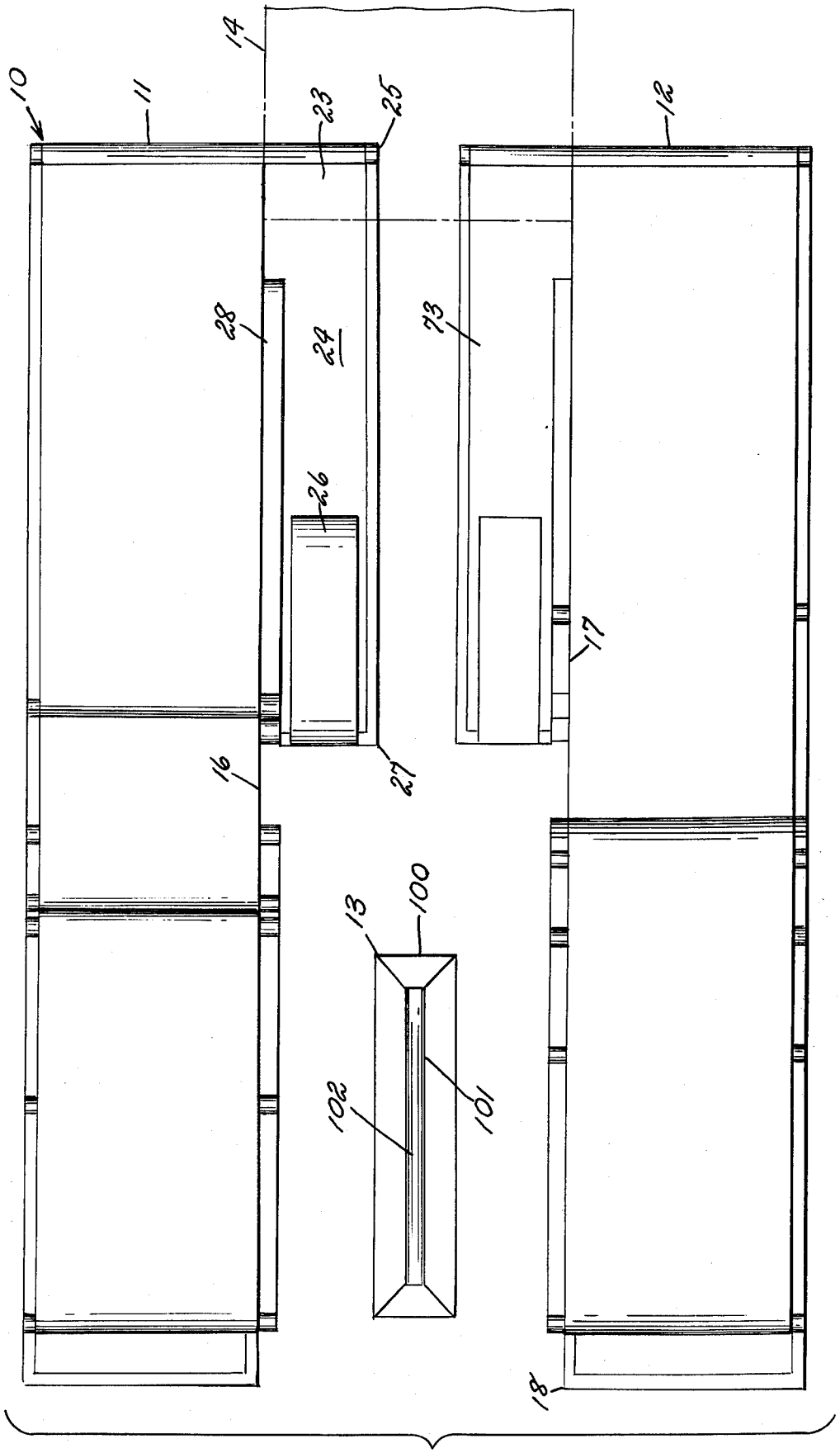
FIG. 1 is a schematic top plan view of the an embodiment of the invention.
Figure 2:
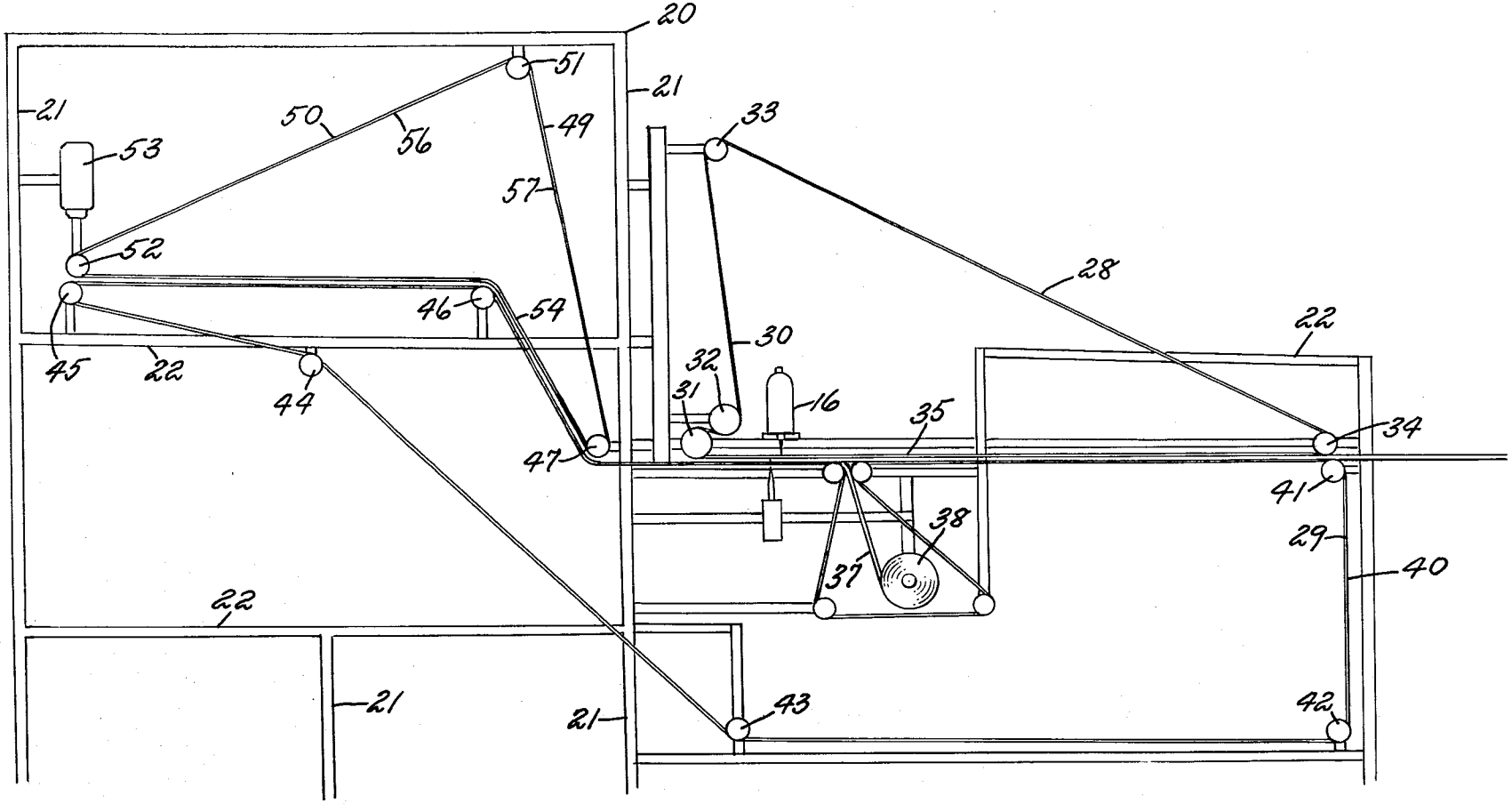
FIG. 2 is a schematic side elevational view thereof, as seen from the plane 2—2 in FIG. 1.

In accordance with the invention, the device, generally indicated by reference character 10, comprises broadly: first and second elongated transport units 11 and 12, respectively; and a stacking element 13. As seen in FIG. 1, precut curtain or drapery panels 14 are introduced between the elements 11 and 12 at a right hand end 15, from which they progress to sewing locations or stations 16 and 17, and subsequently to a left hand end 18 where they are released to fall upon the stacking element 13.

The first transport unit 11 includes a generally elongated frame 20 formed from a plurality of vertical members 21 and a plurality of horizontal members 22. At the rightward end (as seen in FIG. 1) is a receiving table 23 having an upper surface 24 extending from a first end 25 to the vicinity of a relatively broad moving belt 26, and terminating at a second end edge 27. Cooperating with the belt 26 are first and second pre-sewing advancement means 28 and 29 which are driven in synchronism therewith.

The means 28 includes a cogged belt 30 entrained about pulleys 31, 32, 33 and 34 to form a rectilinear continuous lower segment 35 which overlies the upper surface of the belt 26. The sewing station 16 is located immediately adjacent the segment 35, above a buckram or other stiffening web 37 which is fed from a supply roll 38. The web 37 may be fed continuously with operation of the device, wasting a small segment of web between panels, or, preferably, sensing means may be provided to sense the leading and trailing edges of an individual curtain panel 14, and interrupt feeding of the web 37 during those periods in which no sewing takes place.

The means 29 includes a smooth lower belt 40 entrained about pulleys 41, 42, 43, 44, 45, 46 and 47. The belt 40 extends substantially the entire length of the unit 11, and underlies both the belt 30, and a post sewing advancement means 49 including an upper driven cog belt 50 entrained about two additional idler pulleys 51 and 52. Pulley 52 is arranged for periodic vertical movement under the action of a pneumatic cylinder 53.

The belt 50 includes an inclined segment 54, a horizontal segment 55, and a pair of return segments 56 and 57.

Figures 3, 4:
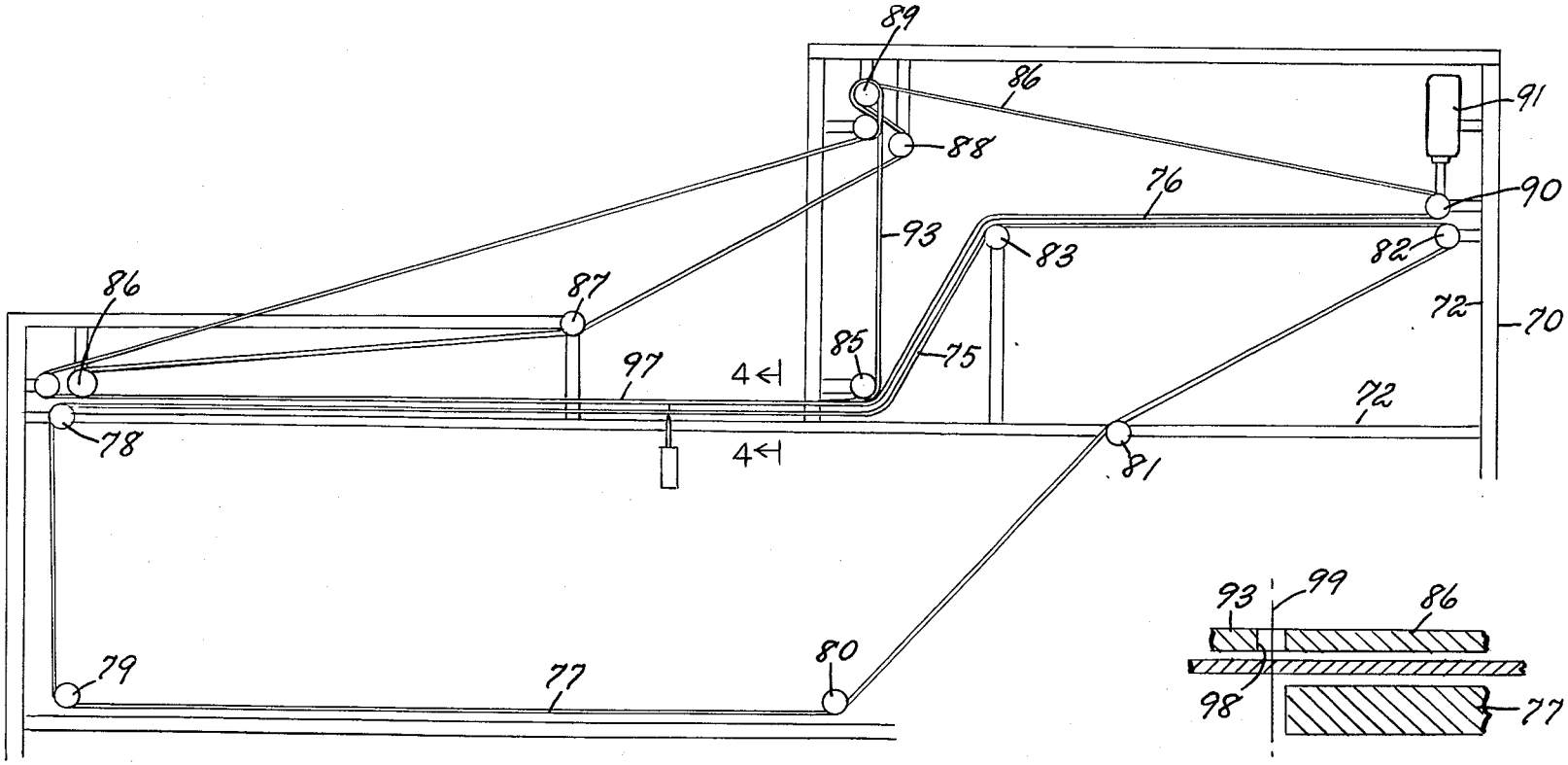
FIG. 3 is a schematic side elevational view thereof, as seen from the plane 3—3 in FIG. 1.
FIG. 4 is a fragmentary englarged sectional view showing the sewing of a strip of stiffening material upon a drapery panel edge.

The second transport element 12 is arranged in spaced parallel relation with respect to the first unit 11, the exact spacing depending upon the width of the panels 14, as the same are cut from a cloth bolt (not shown). This width effectively determines the length or height of the finished curtain panel. As is the case in the first unit 11, a frame element 70 is comprised of vertical members 71 and horizontal members 72. A table section 73 corresponds to the table 23, and is positioned immediately ahead of the sewing station 17. The lower edge of a panel moves through an inclined path 75 and an upper horizontal path 76, so that the path parallels that of the first unit 11. This is accomplished by a continuous lower belt 77 entrained about pulleys 78, 79, 80, 81, 82, and 83. An upper relative wide belt 86 is entrained about additional pulleys 85, 86, 87, 88, 89 and 90, the pulley 90 being vertically reciprocable under the action of a pneumatic cylinder 91. A third narrow belt 93 is entrained about pulleys 94, 95 and 96. The third belt 93 includes a horizontal segment 97 disposed in co-planar relation with respect to the belt 86, and defining a gap 98 therebetween through which a sewing machine needle 99 may pass (FIG. 4). This segment serves the function of a conventional presser foot, and prevents flapping of the individual plies of material which form the hem during the sewing operation. As is the case in the first unit 11, the speed of feed of material determines the length of stitch, and no separate advancement means connected to the sewing machine at the station 17 is used.

The stacking element 13 is of generally elongated configuration, and it includes a base 100 mounting an elongated vertical support 101 having an upper surface 102. It is positioned between the units 11 and 12 adjacent the left hand ends (FIG. 1) thereof.

As will be readily apparent, only a single pulley about which all of the belts 77, 86 and 93 pass need be driven, as compared with the belts of the first unit 11 wherein a gap in the upper belts is necessary to provide means for severing the buckram strip between adjacent panels. In the case of the second unit, the severing of thread at the completion of the sewing of a hemmed edge can be accomplished in any convenient manner, the same occurring in the gap 98, without the necessity of providing a discontinuity in the belt drive.

As it is contemplated that the device 10 be used for operation on curtain panels of varying widths, provision (not shown) may be made to permit the lateral shifting of one transport element with respect to the other, to vary the effective gap therebetween. This may be accomplished most conveniently by mounting one unit on track means and providing a threaded or similar adjustment which may be locked in position.

Because of the lateral adjustability of one transport unit relative to the other, it is not convenient to drive the two units from a common source of power. Most conveniently, each unit is driven by a separate motor (not shown) through an infinitely variable transmission of known type, which permits adjustment necessary to obtain advancement of both edges of the curtain panel at a substantially identical rate. This object does not necessarily require that the speed of the driven belts be identical, since in practice it has been found that slippage of goods between the engaged belts may be greater in one unit than the other.

Although in the embodiment as illustrated, the operation anticipates manual feeding of each panel which has been pre-cut to required dimensions, the operation may be supplemented by providing an automatic feeding means (not shown) of known type, which measures and severs predetermined lengths which are subsequently advanced by belt means. Such devices are known in the art, and form no part of the present disclosure.

During operation, the transport units operate the driving belts on a substantially continuous basis, the successive panels being fed with a minimum gap between the trailing edge of one panel and the leading edge of the next panel. The sewing machines at each sewing station are started and stopped under the control of sensing means which determine the presence of material beneath a respective sewing head. I wish it to be understood that I do not consider the invention limited to the precise details of structure shown and set forth in this specification, for obvious modifications will occur to those skilled in the art to which the invention pertains.

I claim:

1. In a device for simultaneously performing a sewing operation upon a pair of oppositely disposed edges of a substantially rectangular drapery panel or similar article, said device including first and second elongated transport units, each unit including a pair of endless belts for progressively engaging areas of said panel bordering an edge thereof and moving said edge past a sewing station, each sewing station having a sewing machine thereat for applying stitching along a line parallel to a respective edge, the improvement comprising: a third endless belt positioned parallel to and traveling with one of said pair of endless belts at one sewing station, said third endless belt defining a gap with said one of said pair of belts through which a sewing machine needle may extend, said third belt preventing the flapping of material being sewn; whereby said sewing machine may perform its function in the absence of a pressure foot and feeding means, and the feeding of material past said sewing machine is governed solely by the speed of movement of said belts.

2. A device as set forth in claim 1, further comprising a vertically oriented stacking means positioned between said transport units, and means for periodically moving said pair of endless belts of each transport unit apart from each other to release a drapery panel held therebetween and allow the same to fall upon said stacking means.

3. A device as set forth in claim 1, further comprising means for adjusting the interspatial distance between said first and second conveyor units, and means for adjusting the speed of advancement of said pair of belts on said first transport unit relative to said pair of belts on said second transport unit, whereby said panels may be moved past said sewing stations without distortion due to unequal slippage existing between said first and second pairs of belts.

* * * * *